United States Patent [19]

Hirose

[11] Patent Number: 4,671,196

[45] Date of Patent: Jun. 9, 1987

[54] FULLY ROTATING HOOK FOR A LOCK STITCH SEWING MACHINE

[75] Inventor: Tokuzo Hirose, Osaka, Japan

[73] Assignee: Hirose Manufacturing Company Limited, Osaka, Japan

[21] Appl. No.: 782,942

[22] Filed: Oct. 2, 1985

Related U.S. Application Data

[62] Division of Ser. No. 591,194, Mar. 16, 1984, Pat. No. 4,577,572.

[30] Foreign Application Priority Data

Sep. 6, 1983 [JP] Japan ..... 58-164876

[51] Int. Cl.[4] ..... D05B 57/08; D05B 71/02

[52] U.S. Cl. ..... 112/228; 112/256

[58] Field of Search ..... 112/181, 182, 183, 184, 112/228, 231, 256, DIG. 3; 57/124

[56] References Cited

U.S. PATENT DOCUMENTS

| | | | |
|---|---|---|---|
| 730,692 | 6/1903 | Parkes | 112/230 |
| 1,188,818 | 6/1916 | Parkes | 112/256 X |
| 1,596,487 | 8/1926 | Hohmann et al. | 112/228 |
| 2,907,165 | 10/1959 | Adams et al. | 57/124 X |
| 3,509,840 | 5/1970 | Rovin | 112/181 |
| 3,769,925 | 11/1973 | Von Hagen | 112/256 |

FOREIGN PATENT DOCUMENTS

| | | | |
|---|---|---|---|
| 1510918 | 3/1971 | Fed. Rep. of Germany | 57/124 |
| 679949 | 6/1949 | United Kingdom | 112/181 |
| 1000365 | 8/1965 | United Kingdom | 57/124 |

*Primary Examiner*—Wm. Carter Reynolds

*Attorney, Agent, or Firm*—Wenderoth, Lind & Ponack

[57] ABSTRACT

A fully rotating hook includes an outer member or rotary loop taker having a track groove therein and an inner shuttle member or bobbin case a projection extending into the groove. A spaced relation between the track groove and the projection is maintained by feeding compressed air into a clearance therebetween. The compressed air is fed through a plurality of air holes opening into the track groove to direct air jets to upper, lower and radially outermost surfaces of the projection on the bobbin case. Furthermore, the loop taker is rotated on a hollow shaft which has an air passage therethrough for feeding compressed air to the plurality of air holes which open into the track groove of the loop taker.

8 Claims, 8 Drawing Figures

FULLY ROTATING HOOK FOR A LOCK STITCH SEWING MACHINE

This is a division of application Ser. No. 591,194, filed Mar. 16, 1984, now U.S. Pat. No. 4,577,572.

BACKGROUND OF THE INVENTION

1. Field of the Invention

The present invention generally relates to a fully rotary or rotating hook for a sewing machine and more particularly, to an improved construction of a fully rotating hook for eliminating disadvantages due to rotational friction between an inner shuttle member or bobbin case and an outer shuttle member or loop taker.

2. Description of the Prior Art

In FIGS. 1 and 2 illustrating a prior art arrangement, there is shown a vertically fully rotating hook 1 which is held at a needle descending position, with an inner shuttle member or bobbin case 3 accommodated in an outer shuttle member or rotary loop taker 2. In the inner bobbin case 3, there is mounted a bobbin 11 for winding a bobbin thread therearound. The inner bobbin case 3 is stopped against rotation by an inner loop taker retaining member (not shown) which is fixed to a machine body. Along an outer peripheral surface of the inner bobbin case 3, there is formed an externally directed flange-like track projection 5 extending in a circumferential direction partially throughout the circumference. This projection 5 is fitted into an internally directed flange-like track groove 6 extending in a circumferential direction along a portion of the inner peripheral surface of the outer loop taker 2. The outer loop taker 2 may be driven for rotation in one direction about an axis by a drive means (not shown) connected to a rotary shaft 16. For rotating the outer loop taker 2 in the state where the inner bobbin case 3 is stopped from rotation as described above, a lubricating oil or the like is supplied between contact faces 4 of the track projection 5 of the inner bobbin case 3 and the track groove 6 of the outer loop taker 2 so as to reduce friction between such two elements.

In this prior art device, however, during high speed rotation of the vertical fully rotating hook 1, friction still exists between the outer loop taker 2 and the inner bobbin case 3, even when the lubricating oil or the like is applied thereto, thus resulting in abrasion of the rotary hook 1. Moreover, the thread or the like tends to be soiled by the lubricating oil, and thus it has been difficult to carry out a sewing operation smoothly in an efficient manner.

SUMMARY OF THE INVENTION

Accordingly, it is a primary object of the present invention to provide an improved fully rotating hook in which smooth movements between an outer shuttle member or rotary loop taker and an inner shuttle member or bobbin case can be achieved without employment of lubricating oil, thereby eliminating the technical problems described above.

In accomplishing the above object, the fully rotating hook for a lock stitch sewing machine according to the present invention includes an outer shuttle member or rotary loop taker having formed therein a track groove, with at least one air blast hole formed in the track groove. A spaced relation is maintained between the track groove and a projection of the inner bobbin case by jetting compressed air from the air blast hole into a clearance between the surfaces of the groove and the projection.

DETAILED DESCRIPTION OF THE PREFERRED EMBODIMENTS

Figure 1:
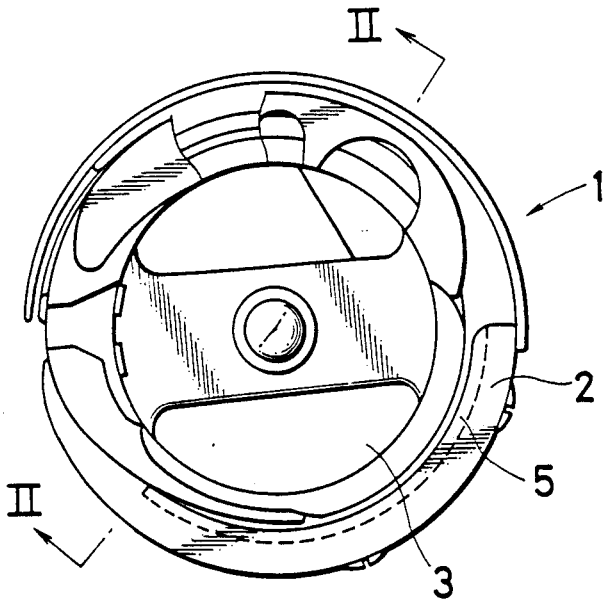
Fig. 1 Prior Art
FIG. 1 is a top plan view of a conventional fully rotating hook.
Figure 2:
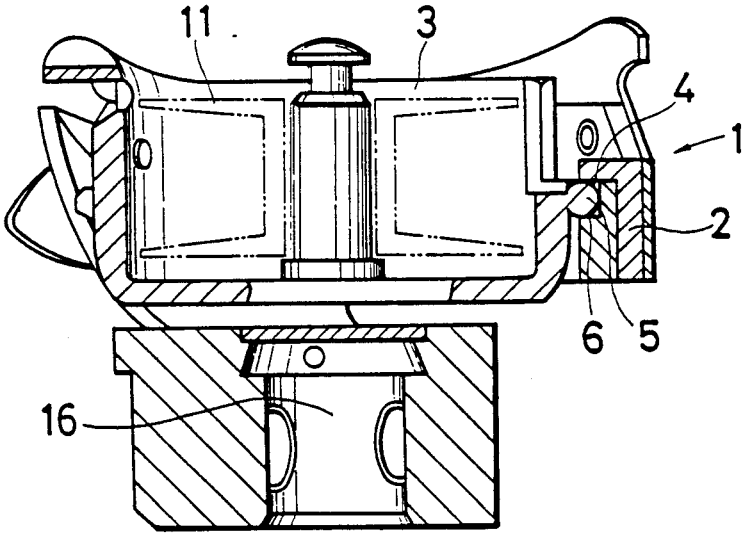
Fig. 2 Prior Art
FIG. 2 is a cross section taken along the line II—II in FIG. 1.
Figure 3:
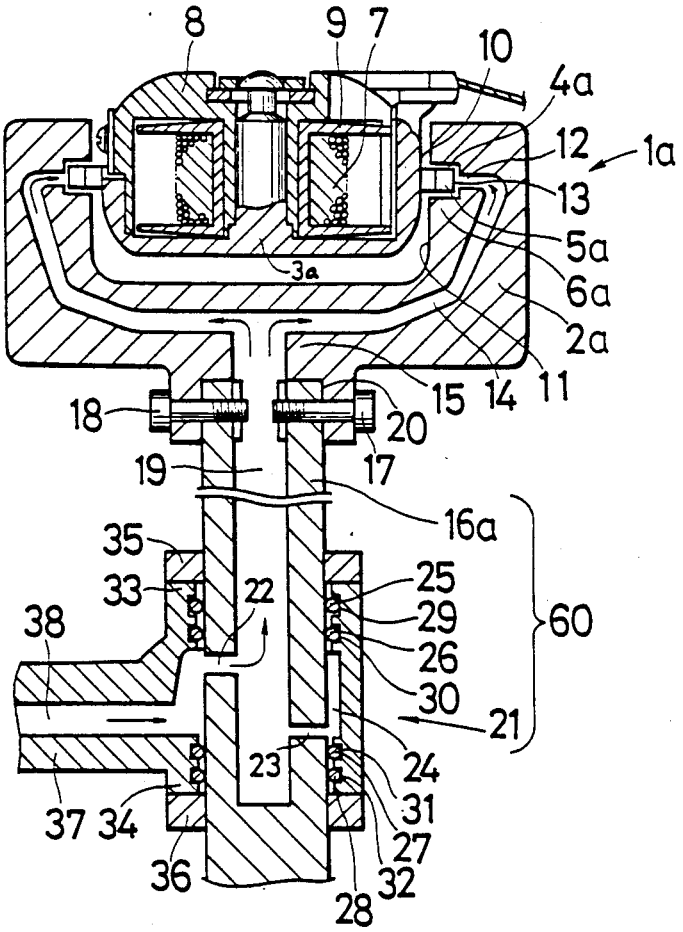
FIG. 3 is a longitudinal sectional view of a fully rotating hook according to one preferred embodiment of the present invention.

Referring to FIG. 3, there is shown a longitudinal sectional view of one preferred embodiment according to the present invention, in which portions corresponding to like parts in the prior art arrangement of FIG. 2 are designated by similar reference numerals, but followed by the suffix "a".

In the arrangement of FIG. 3, an upper bobbin case member 8 is mounted within an inner shuttle member or lower bobbin case member 3*a*. A bobbin 9 having wound therearound thread 7 is accommodated within members 3*a* and 9. A track projection 5*a* extends outwardly in the circumferential direction, partially through out the circumference as in the prior art arrangement described above, from an outer peripheral surface of member 3*a*, and projection 5*a* is fitted into a circumferentially extending track groove 6*a* formed in an inner peripheral surface 11 of outer shuttle member or rotary loop taker 2*a*, partially throughout the circumference thereof. In the track groove 6*a* of the outer loop taker 2*a*, one or more air blast holes 12 are formed to confront an outer portion 13 of the projection 5*a* of member 3*a*. These air blast holes 12 are communicated with a hollow portion or passages 14 of the outer loop taker 2*a*.

Into a bottom portion 15 of the outer loop taker 2*a* is fitted one end of a cylindrical rotary shaft 16*a* which is positioned coaxially with the axis of outer loop taker 2*a*. The hollow portion 14 of the outer loop taker 2*a* is communicated with a hollow portion or passage 19 of the rotary shaft 16*a*, while a fitting 20 between the outer loop taker 2*a* and the rotary shaft 16*a* is fixed by fixing members 17 and 18 so as to achieve airtightness.

In the vicinity of a central portion of the rotary shaft 16*a*, there are provided vent holes 22 and 23. A cylindrical pipe joint 21 is coaxially mounted about the rotary shaft 16*a* in a manner to cover vent holes 22 and 23. The pipe joint 21 has an inner diameter slightly larger than an outer diameter of the rotary shaft 16*a*, and a clearance 24 between the pipe joint 21 and the rotary shaft 16*a* is communicated with the hollow portion 19 of the rotary shaft 16*a* through the vent holes 22 and 23. At positions bridging the vent holes 22 and 23 of the rotary shaft 16*a* in the clearance 24, there are mounted O rings 25, 26, 27 and 28 which contact the outer peripheral surface of the rotary shaft 16*a* in circumferential directions. These O rings 25 to 28 are respectively fitted into concave grooves 29, 30, 31 and 32 extending in circumferential directions along the inner peripheral surface of the pipe joint 21. Concave grooves 29 to 32 prevent displacement of the positions of the O rings 25 to 28. Owing to the O rings 25 to 28 mounted to bridge the vent holes 22 and 23 in the manner described above, it is possible to prevent air leakage through the clearance 24 between the pipe joint 21 and the rotary shaft 16*a*. Moreover, at opposite axial ends 33 and 34 of the pipe joint 21, there are provided bearings 35 and 36 which rotatably support the rotary shaft 16*a* extending through the pipe joint 21.

The clearance 24 between the rotary shaft 16*a* and the pipe 21 leading to the hollow portion 19 of the rotary shaft 16*a* is communicated with a hollow portion or passage 38 of an air feed pipe 37 extending from the pipe joint 21, with the end portion of the air feed pipe 37 being connected to an air compressor pump, not shown.

The compressed air fed from the air compressor pump passes through the air feed pipe 37 and is fed from clearance 24 through vent holes 22 and 23 into the hollow portion 19 of the rotary shaft 16*a*. The compressed air is further fed from the hollow portion 19 of the rotary shaft 16*a* through the hollow portion 14 of the outer loop taker 2*a* and through the air blast holes 12. Thus, the compressed air is jetted from the air blast holes 12 into a clearance 4*a* between the track groove 6*a* and the projection 5*a*. As a result, an air film is formed in the clearance 4*a*, and thus, the sliding resistance or friction between the rotating track groove 6*a* and the stationary projection 5*a* are eliminated.

By providing the air blast mechanism as described above in the outer loop taker 2*a*, high speed operations at speeds of more than 5000 to 6000 stitches per minute, which are considered to be a limit in sewing machines employing conventional fully rotating hooks, may be advantageously realized. Moreover, through elimination of the sliding resistance between the outer loop taker 2*a* and the inner bobbin case 3*a*, sliding noises occurring in conventional hooks are eliminated, with a consequent elimination of an unpleasant atmosphere for operators of the sewing machine. Furthermore, since air under high pressure is directed towards the inner bobbin case 3*a* at all times, it is possible to simultaneously obtain a cleaning effect and cooling effect for the fully rotating hook 1*a*. It is to be noted that materials for the inner bobbin case 3*a* may be light weight alloys, plastics, etc.

Figure 4:
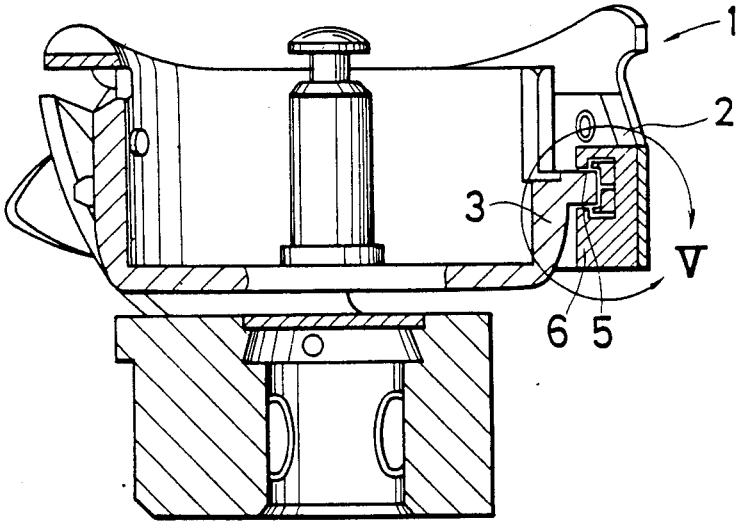
FIG. 4 is a view similar to a portion of FIG. 3, but of another embodiment of the invention.
Figure 5:
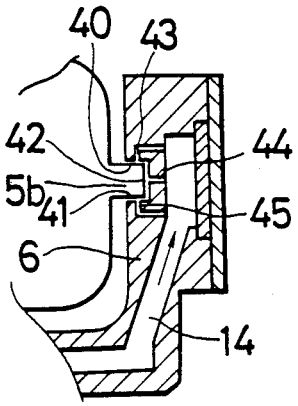
FIG. 5 is a fragmentary cross sectional view on an enlarged scale of a section V in FIG. 4.

FIG. 4 is a longitudinal sectional view of another embodiment according to the present invention, while FIG. 5 is a cross sectional view showing a section V in FIG. 4 on an enlarged scale. The construction of FIG. 4 resembles that of FIG. 3, with corresponding parts being designated by similar reference numerals, but followed by the suffix "b". A track projection 5*b* of the inner shuttle member or bobbin case 3*b* is fitted into the track groove 6*b* of the outer shuttle member or loop taker 2*a*. In the track groove 6*b* are formed air blast holes 43, 45 and 44 respectively confronting side portions 40 and 41 and outer portion 42 of the projection 5*b*. Blast holes 43 to 45 are communicated with a hollow portion 14*b* of the outer loop taker 2*a*. By jetting the compressed air in the three illustrated directions shown in FIG. 5, the surfaces of the projection 5*b* and the track groove 6*b* may be positively maintained in spaced relation from each other, and the functions of the fully rotating hook 1*b* further will be improved.

Figure 6:
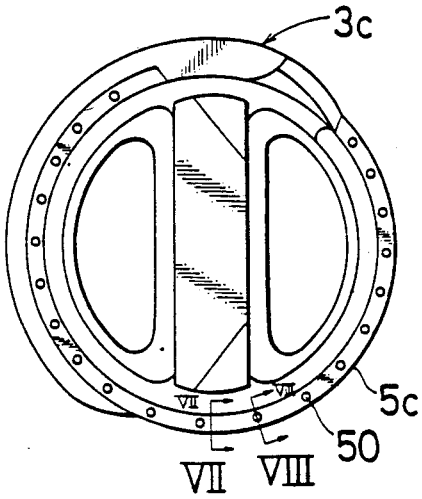
FIG. 6 is a top plan view of an inner shuttle member or bobbin case according to a further embodiment of the present invention.
Figure 7:
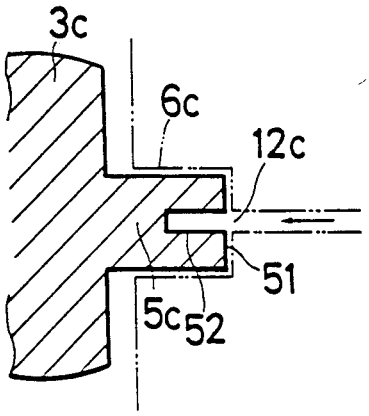
FIG. 7 is a fragmentary cross section taken along the line VI—VI in FIG. 6.
Figure 8:
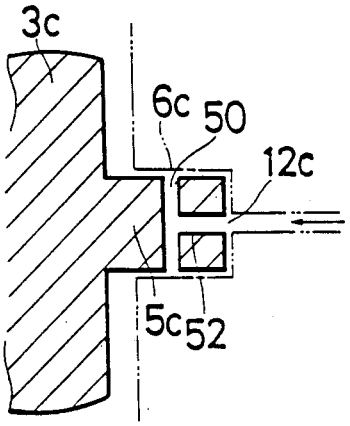
FIG. 8 is a fragmentary cross section taken along the line VIII—VIII in FIG. 6.

FIG. 6 is a top plan view of an inner shuttle member or bobbin case 3*c* according to a further embodiment of the present invention, FIG. 7 is a cross section taken along the line VII—VII in FIG. 6, and FIG. 8 is also a cross section taken along the line VIII—VIII in FIG. 6. In an outer portion 51 of a track projection 5*c* of the inner bobbin case 3*c* is formed a circumferential concave groove 52. At least one or more elongated openings 12*c* are provided in a track groove 6*c* to confront groove 52. Also, exhaust holes 50 connected with concave groove 52 are formed in projection 5*c* to extend in vertical upward and downward directions. The exhaust holes 50 are provided at spaced intervals in the circumferential direction of the projection 5*c*.

The compressed air fed from the compressor pump is jetted from the elongated openings 12*c* of the outer loop taker into the concave groove 52 of the projection 5*c* of the inner bobbin case 3*c*, and is discharged through the exhaust holes 50 connected with the concave groove 52. By discharging the compressed air from the exhaust holes 50 extending in the upward and downward directions of the projection 5*c* as described above, a spaced relation between the surfaces of projection 5*c* and the track groove 6*c* may be positively achieved.

The vertical fully rotating hook according to each embodiment of the present invention may be readily coupled with the air jetting device 60 shown in FIG. 3, without requiring a large-scale remodeling of the conventional sewing machine. Moreover, the present invention may also be applied to a horizontal fully rotating hook as well.

As is clear from the foregoing description, according to the present invention it is possible to prevent the rotating hooks from being abraded due to high speed rotation by eliminating the undesirable sliding resistance or friction between the inner shuttle member or bobbin case and the outer shuttle member or loop taker through employment of compressed air. Furthermore, owing to the elimination of soiling of threads and the like by oil as experienced in conventional arrangements, the fully rotating hook according to the present invention provides marked improvements of the sewing performance and productivity.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. In a fully rotating hook assembly for a lock stitch sewing machine and being of the type including an inner bobbin case for supporting a thread bobbin, said bobbin case having formed on an outer peripheral surface thereof a track projection extending circumferentially of said bobbin case over a portion of and only partially throughout the circumference thereof, an outer loop taker mounted about said bobbin case, said loop taker having formed in an inner peripheral surface thereof a track groove extending circumferentially of said loop taker over a portion of and only partially throughout the circumference thereof, means for rotating said loop taker about an axis such that relative rotation occurs between said loop taker and said bobbin case, with such rotation being guided by said projection fitting within said groove, and means for reducing friction during such rotation between adjacent surfaces of said projection and groove, the improvement wherein said friction reducing means comprises:

means for injecting compressed air into a clearance between said adjacent surfaces and thereby for forming air films between upper, lower and radially outermost said surfaces of said projection and adjacent complementary said surfaces of said groove, said injecting means comprising at least one air passage formed in said loop taker, a plurality of air holes opening into said groove and connected to said air passage, and means for supplying compressed air to said air passage and thereby injecting the compressed air through said air holes into said clearance, said air holes confronting and directing air jets toward each of said upper, lower and radially outermost surfaces of said projection.

2. The improvement claimed in claim 1, wherein said axis extends in a vertical direction.

3. The improvement claimed in claim 1, wherein said at least one air passage comprises a single air passage and said plurality of air holes are connected to said single air passage in said loop taker.

4. The improvement claimed in claim 1, wherein said means for rotating said loop taker comprises a hollow rotatable shaft which is connected to said loop taker and rotatable about said axis; and, said means for supplying compressed air to said air passage formed in said loop taker comprises a hole extending through said hollow shaft, a passage in said hollow shaft connecting said hole to said air passage in said loop taker and means for introducing compressed air through said hole into said passage in said hollow shaft.

5. The improvement claimed in claim 4, wherein said introducing means comprises a pipe fixed in position surrounding a portion of said hollow shaft having therein said hole, said hollow shaft being rotatable within said pipe, means defining a sealed clearance between said hollow shaft and said pipe, said sealed clearance being connected to said hole, and an air feed pipe connected to said pipe for supplying compressed air therethrough and into said sealed clearance.

6. In a vertically oriented fully rotating hook assembly for a lock stitch sewing machine and being of the type including an inner bobbin case for supporting a thread bobbin, said bobbin case having formed on an outer peripheral surface thereof a track projection extending circumferentially of said bobbin case over a portion of and only partially throughout the circumference thereof, an outer loop taker mounted about said bobbin case, said loop taker having formed in an inner peripheral surface thereof a track groove extending circumferentially of said loop taker over a portion of and only partially throughout the circumference thereof, means for rotating said loop taker about a vertical axis such that relative rotation occurs between said loop taker and said bobbin case, said rotating means including a rotatable shaft connected to said loop taker, said rotatable shaft being rotatable about said axis, with such rotation being guided by said projection fitting within said groove, and means for reducing friction during such rotation between adjacent surfaces of said projection and groove, the improvement wherein said friction reducing means comprises:

means for injecting compressed air into a clearance between said adjacent surfaces and thereby for forming air films between upper, lower and radially outermost said surfaces of said projection and adjacent complementary upper, lower and radially innermost said surfaces of said groove, said injecting means comprising at least one air passage formed in said loop taker, a plurality of air holes in said loop taker opening into said groove and connected to said air passage, and means for supplying compressed air to said air passage and thereby injecting the compressed air through said air holes into said clearance, said air holes confronting and directing air jets toward each of said upper, lower and radially outermost surfaces of said projection.

7. The improvement claimed in claim 6, wherein said means for supplying compressed air to said air passage formed in said loop taker comprises a hole extending through said hollow shaft, a passage in said hollow shaft connecting said hole to said air passage in said loop taker and means for introducing compressed air through said hole into said passage in said hollow shaft.

8. The improvement claimed in claim 7, wherein said introducing means comprises a pipe fixed in position surrounding a portion of said hollow shaft having therein said hole, said hollow shaft being rotatable within said pipe, means defining a sealed clearance between said hollow shaft and said pipe, said sealed clearance being connected to said hole, and an air feed pipe connected to said pipe for supplying compressed air therethrough and into said sealed clearance.

* * * * *